US010992112B2

(12) United States Patent
Zheng et al.

(10) Patent No.: US 10,992,112 B2
(45) Date of Patent: Apr. 27, 2021

(54) FOULING RESISTANT SPARK PLUGS

(71) Applicant: FRAM GROUP IP LLC, Lake Forest, IL (US)

(72) Inventors: Jing Zheng, Findlay, OH (US); Ronald P. Rohrbach, Flemington, NJ (US); Peter D. Unger, Morristown, NJ (US); Jeffrey T. Boehler, Holland, OH (US)

(73) Assignee: FRAM GROUP IP LLC, Lake Forest, IL (US)

( * ) Notice: Subject to any disclaimer, the term of this patent is extended or adjusted under 35 U.S.C. 154(b) by 0 days.

(21) Appl. No.: 15/863,427

(22) Filed: Jan. 5, 2018

(65) Prior Publication Data

US 2019/0214794 A1 Jul. 11, 2019

(51) Int. Cl.

| | |
|---|---|
| ***H01T 13/14*** | (2006.01) |
| ***H01T 13/38*** | (2006.01) |
| ***H01T 21/02*** | (2006.01) |

(52) U.S. Cl.

CPC ..... *H01T 13/38* (2013.01); *H01T 21/02* (2013.01); *H01T 13/14* (2013.01)

(58) Field of Classification Search

CPC ..... H01T 13/14; H01T 13/38
USPC ..... 313/141
See application file for complete search history.

(56) References Cited

U.S. PATENT DOCUMENTS

| | | | | |
|---|---|---|---|---|
| 3,668,749 | A | 6/1972 | Podiak | |
| 3,790,842 | A | 2/1974 | Westenkirchner et al. | |
| 3,870,987 | A | 3/1975 | Wiley | |
| 4,173,731 | A | 11/1979 | Takagi | |
| 4,525,140 | A | 6/1985 | Larigaldie | |
| 5,858,942 | A | 1/1999 | Adams | |
| 5,859,491 | A | 1/1999 | Nishikawa et al. | |
| 5,873,338 | A * | 2/1999 | Matsubara | H01T 13/08 123/169 EL |
| 6,060,821 | A | 5/2000 | Suzuki | |
| 6,166,481 | A | 12/2000 | Knapp et al. | |
| 6,628,050 | B1 * | 9/2003 | Kameda | H01T 13/20 313/141 |
| 6,909,226 | B2 | 6/2005 | Suzuki | |
| 7,969,077 | B2 | 6/2011 | Hoffman | |
| 2002/0053298 | A1 | 5/2002 | Fogle | |

(Continued)

FOREIGN PATENT DOCUMENTS

| | | |
|---|---|---|
| CN | 1728480 | 2/2006 |
| JP | 52-054844 | 5/1977 |
| JP | 2001-319755 | 11/2001 |

OTHER PUBLICATIONS

White, William B., "Theory of Corrosion of Glass and Ceramics," Retrieved online Apr. 24, 2012,http://www.semos.dk/Per141653/download/Korrosion%20af%20glas%20og%20keramik.pdf.

*Primary Examiner* — Christopher M Raabe
(74) *Attorney, Agent, or Firm* — Miller Canfield

(57) ABSTRACT

A spark plug includes an insulative sleeve. A glaze coating is disposed on an exterior surface of the insulative sleeve. The glaze coating includes a boric acid, a borosilicate glass, a barium borate glass, a phosphorous glass, a silicate glass, or a combination thereof. The glasses are independently modified with a modifier selected from the group consisting of alkali group metals, alkali earth group metals, aluminum, silicon, a halogen, or a combination thereof. The glaze coating has a softening point between about 650° C. and about 1100° C.

14 Claims, 8 Drawing Sheets
(7 of 8 Drawing Sheet(s) Filed in Color)

(56) References Cited

U.S. PATENT DOCUMENTS

| | | | | |
|---|---|---|---|---|
| 2003/0051341 | A1 | 3/2003 | Nishikawa | |
| 2003/0122462 | A1 | 7/2003 | Nishikawa et al. | |
| 2004/0084659 | A1 | 5/2004 | Imai | |
| 2004/0135483 | A1* | 7/2004 | Nunome | H01T 13/38 313/140 |
| 2011/0248620 | A1* | 10/2011 | Shibata | H01C 17/0652 313/141 |
| 2012/0169205 | A1 | 7/2012 | Unger et al. | |
| 2013/0300278 | A1* | 11/2013 | Rohrbach | H01T 13/38 313/141 |

* cited by examiner

FOULING RESISTANT SPARK PLUGS

TECHNICAL FIELD

The present teachings relate generally to spark plugs and, in some embodiments, to fouling-resistant insulators for spark plugs.

BACKGROUND

Spark plugs used as igniters in internal combustion engines are subject to a condition known as "fouling." Over time, carbon and other combustion products may accumulate on the surface of an insulator tip, which is typically positioned at or near the boundary of unmixed fuel. The combustion products of a gasoline engine may include fuel additive components, such as methylcyclopentadienyl manganese tricarbonyl (MMT) and ferrocene, which are often added to gasoline (e.g., as octane enhancers or anti-knock additives). Ferrocene and MMT fuel additives are commonly used outside of North America as well as in special racing applications in order to increase fuel octane rating and prevent detonation.

During the combustion process, additives such as MMT and ferrocene will burn out and leave behind conductive deposits on the tip of a spark plug insulator. For example, MMT may leave behind manganese oxide deposits and ferrocene may leave behind iron oxide deposits. If significant amounts of these combustion products accumulate, a spark may not properly form between the center and ground electrodes. In effect, the accumulated combustion products create an electrical short circuit, such that the charge from the center electrode travels across the surface of the insulator and back to the outer metal shell.

The accumulation over time of conductive deposits on the insulator tip may eventually lead to misfiring of the spark plug, which reduces the efficiency of the combustion cycle and generates higher than normal partially burned fuel exhaust. In extreme cases, the conductive deposits may lead to pre-ignition and engine damage. Moreover, field tests indicate that the deposits from MMT and ferrocene are often fairly reactive. Thus, at combustion temperature, these deposits may react with an insulator ceramic and form different phases with alumina and glass grain boundary phases in alumina. As a result, defects (e.g., cracks) may form due to thermal mismatch and/or the thermal characteristics of the insulator (e.g., heat range) may change. Potentially, undesired heat spot may develop that in turn could lead to pre-ignition.

SUMMARY

The scope of the present invention is defined solely by the appended claims, and is not affected to any degree by the statements within this summary.

By way of introduction, a first spark plug embodying features of the present teachings includes (a) an insulative sleeve having a central axial bore and an exterior surface, wherein a glaze coating is disposed on the exterior surface; (b) a center electrode extending through the central axial bore of the insulative sleeve and having a firing tip that extends beyond the top edge of the insulative sleeve; (c) a metal shell, wherein the insulative sleeve is positioned within and secured to the metal shell; and (d) a ground electrode supported by the metal shell and positioned in a spaced relationship relative to the center electrode so as to generate a spark gap. The glaze coating has a softening point between about 650° C. and about 1100° C., and the glaze coating includes (i) a glass material selected from the group consisting of boric acid, a borosilicate glass, a barium borate glass, a phosphorous glass, a silicate glass, and a combination thereof, and (ii) a modifier selected from the group consisting of an alkali group metal, an alkali earth group metal, aluminum, silicon, a halogen, and a combination thereof. The glaze coating is a continuous band located about 0.1 to about 5 millimeters from a top edge of the insulative sleeve. The band has a width of about 1 to about 20 mm.

A second spark plug embodying features of the present teachings includes an insulative sleeve having a glaze coating thereon, wherein the insulative sleeve has a resistance of at least 11 Gohms at 300° C. when the insulative sleeve undergoes heat treatment at a temperature of between about 700° C. and about 1000° C.

A third spark plug embodying features of the present teachings includes (a) an insulative sleeve having a glaze coating thereon; and (b) an electrode having a firing tip extending beyond the insulative sleeve. The resistance of the glaze coating at a position below the firing tip is greater than 80 Mohms at 350° C. to 400° C.

A method of making a fouling resistant spark plug embodying features of the present teachings includes: (a) providing a spark plug subassembly that includes an insulative sleeve, a center electrode, a resistor, and a terminal stud end; (b) applying a dispersion to at least a portion of an exterior surface of the insulative sleeve, the dispersion containing a glaze coating; and (c) air-drying the dispersion, thereby forming a coated spark plug assembly. The glaze coating has a softening point between about 650° C. and about 1100° C. and includes (i) a glass material selected from the group consisting of boric acid, a borosilicate glass, a barium borate glass, a phosphorous glass, a silicate glass, and a combination thereof, and (ii) a modifier selected from the group consisting of an alkali group metal, an alkali earth group metal, aluminum, silicon, a halogen, and a combination thereof. The glaze coating forms a continuous band located about 0.1 to about 5 millimeters from a top edge of the insulative sleeve, and the band has a width of about 1 to about 20 mm.

BRIEF DESCRIPTION OF THE DRAWINGS

The patent or application file contains at least one drawing executed in color. Copies of this patent or patent application publication with color drawing(s) will be provided by the office upon request and payment of the necessary fee.

DETAILED DESCRIPTION

Glaze coating compositions for coating spark plug insulator tips and methods for making spark plugs containing glazed insulative sleeves have been discovered and are described herein. Spark plugs containing coated insulative sleeves in accordance with the present teachings may be resistant to fouling caused by the accumulation of combustion products on the insulator tip. Moreover, the misfiring of spark plugs containing coated insulative sleeves in accordance with the present teachings when used in engine-consuming fuels containing MMT and/or ferrocene additives may be prevented.

As further described below, a glaze tip coating in accordance with the present teachings may be applied to a spark plug insulator in order to prevent issues associated with MMT and ferrocene fouling. In some embodiments, the glaze coating materials are primarily applied to the nose cone portion of the spark plug insulator, which is exposed to the combustion engine chamber. In accordance with the present teachings, the softening temperature of the glaze material is selected in order to match that of the temperature of the combustion chamber, so that the glaze coating will be reactive to MMT deposits and/or ferrocene deposits but not too soft to be able to flow while the engine is running. In some embodiments, depending on the engine applications, a softening temperature of the glaze coating may be varied between about 650° C. and about 1100° C. In some embodiments, the glaze is located from about 1 to about 3 mm away from the central axial bore, so that the glaze will not adversely affect the heat range of the spark plug.

Figure 1:
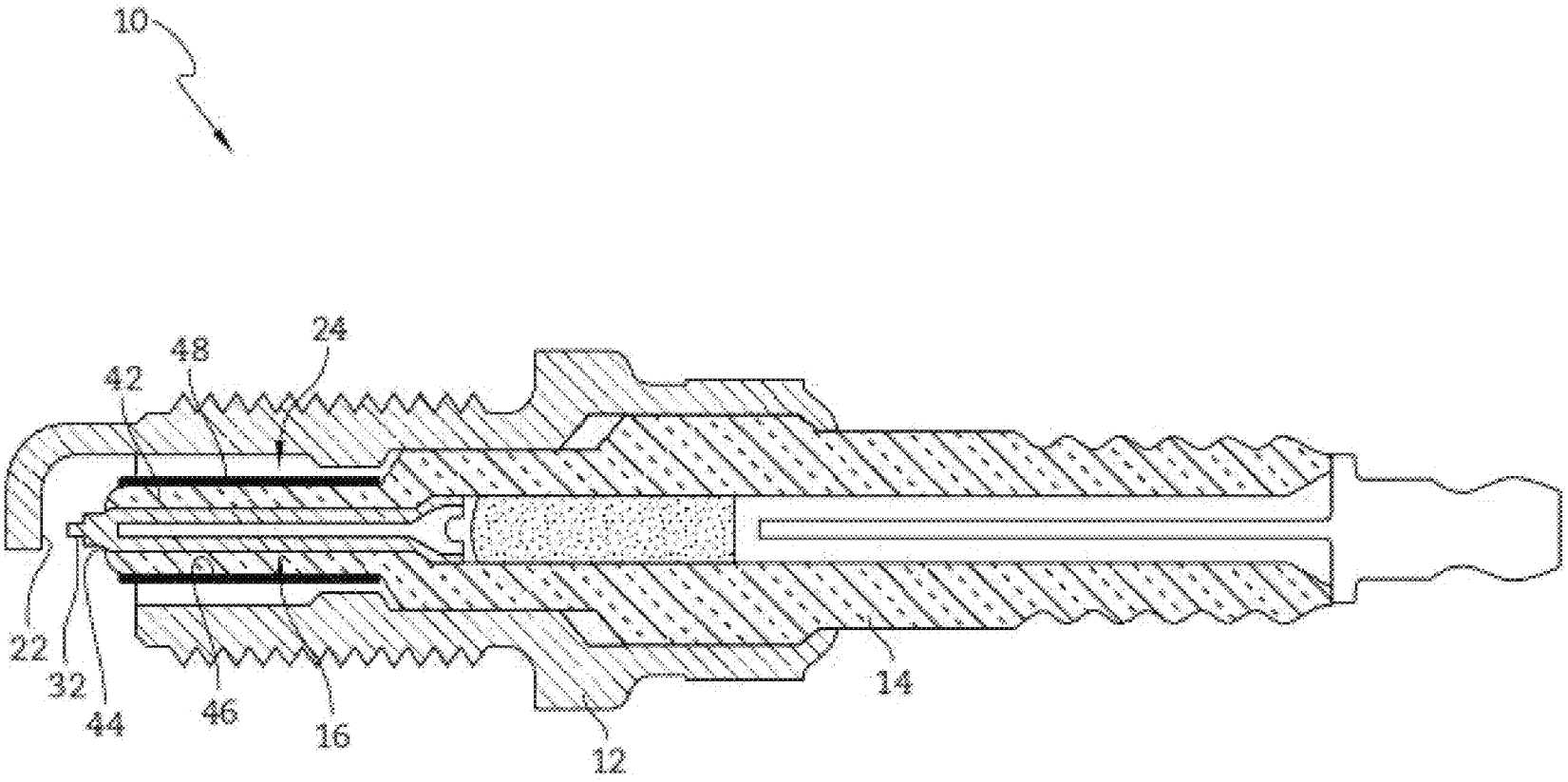
FIG. 1 shows a cross-sectional view of an exemplary embodiment of a spark plug in accordance with the present teachings.

As shown in FIG. 1, a representative spark plug 10 in accordance with the present teachings includes an insulative sleeve 14 having a central axial bore 16, an exterior surface 46, and a center electrode 32 extending through the central axial bore 16 of the insulative sleeve 14. The insulating sleeve 14 is positioned within and secured to a metal shell 12 that serves as a mounting platform and interface to an internal combustion engine. The metal shell 12 also supports a ground electrode 22 that is positioned in a spaced relationship relative to the center electrode 32 so as to generate a spark gap. The insulating sleeve 14 includes a shaped tip portion 42 that resides in a recessed end portion 24 of the metal shell 12. A glaze coating 48 is disposed on the exterior surface 46 of the insulative sleeve 14. The glaze coating 48, as further described below, comprises boric acid, a borosilicate glass, a barium borate glass, a phosphorous glass, a silicate glass, or a combination thereof. The glasses may include a material selected from the group consisting of alkali group metals (e.g., alkali group metal oxides), alkali earth group metals (e.g., alkali earth group metal oxides), aluminum (e.g., alumina), silicon (e.g., silica), halogen (e.g., chloride), and a combination thereof.

The glaze coating 48, as described herein, may be a continuous or discontinuous coating. The glaze coating 48 may initially be continuous (e.g., no breaks or gaps visible to the naked eye) but may evolve breaks and/or gaps with use. In some embodiments, as shown in FIG. 1, the glaze coating 48 is continuous and forms a band around the insulative sleeve 14. The band is located from about 0.1 to about 5 millimeters (mm) from the top edge 44 of the insulative sleeve 14. The top edge 44 of the insulative sleeve 14 is the edge located closest to the central electrode 32 protruding through the central bore of the insulative sleeve 14. The glaze coating band 48 may have a width from about 1 to about 20 mm. The width of the band 48 may depend on the insulator design and may be determined by one of skill in the art. It is contemplated that multiple bands may be employed. The glaze coating thickness may range from about 1 to about 500 micrometers, in some embodiments from about 100 micrometers to about 400 micrometers, in some embodiments from about 300 micrometers to about 400 micrometers, and in some embodiments, from about 10 micrometers to about 100 micrometers. Thicker glaze coatings are configured to absorb more MMT and/or ferrocene deposits. However, thicker coatings may exhibit a greater tendency to crack.

While neither desiring to be bound by any particular theory nor intending to limit in any measure the scope of the appended claims or their equivalents, it is presently believed that the glaze coating prevents and/or reduces adhesion of MMT deposits and/or ferrocene deposits on the spark plug through a process involving diffusion. For example, MMT deposits (e.g., manganese oxides) and/or ferrocene deposits (e.g., iron oxides) may diffuse into the structure of the glass, thereby becoming part of the glass such that electrical conductivity is reduced or eliminated (e.g., electrical resistance is increased) as compared to an uncoated insulative sleeve with an equivalent amount of MMT and/or ferrocene deposits. For this reason, as described above, the softening temperature of the glaze material desirably matches the temperature of the combustion chamber, so that the glaze coating will be reactive to MMT deposits and/or ferrocene deposits but not too soft to be able to flow while the engine is running.

In accordance with the present teachings, the glaze coating may provide a surface that is more resistant to black soot discoloration and, therefore, one that is more resistant to carbon soot fouling/buildup as compared to an untreated insulative sleeve. In application, the MMT and/or ferrocene deposits may vary along the length of the spark plug. In addition, when the MMT and/or ferrocene deposits dissolve in the glaze coating, the composition and the properties of the glaze coating are thereby altered. Other challenges to solving the problem of MMT and/or ferrocene deposits include minimizing volatility of the glaze coating at the operating temperature of the spark plug coupled with having a glaze coating composition with a glass transition temperature appropriate to assist with solvation of the MMT and/or ferrocene deposits. In addition, viscosity of the glaze coating at the operating temperature of the spark plug must be adequate to prevent the glaze coating from slipping to an undesired location on the spark plug.

In some embodiments, a glaze coating for a spark plug insulator in accordance with the present teachings includes a boric acid, a borosilicate glass, a barium borate glass, a phosphorous glass, a silicate glass, or a combination thereof. The glasses may include a material selected from the group consisting of alkali group metals (e.g., alkali group metal oxides), alkali earth group metals (e.g., alkali earth group metal oxides), aluminum (e.g., alumina), silicon (e.g., silica), a halogen (e.g., chloride), and a combination thereof. In some embodiments, the coating material has a softening point between about 650° C. and about 1100° C.

The softening point of a glaze coating in accordance with the present teachings may be one of several different values or fall within one of several different ranges. For example, it is within the scope of the present teachings to select a softening point to be any one of the following values: about 650° C., 651° C., 652° C., 653° C., 654° C., 655° C., 656° C., 657° C., 658° C., 659° C., 660° C., 661° C., 662° C., 663° C., 664° C., 665° C., 666° C., 667° C., 668° C., 669° C., 670° C., 671° C., 672° C., 673° C., 674° C., 675° C., 676° C., 677° C., 678° C., 679° C., 680° C., 681° C., 682° C., 683° C., 684° C., 685° C., 686° C., 687° C., 688° C., 689° C., 690° C., 691° C., 692° C., 693° C., 694° C., 695° C., 696° C., 697° C., 698° C., 699° C., 700° C., 701° C., 702° C., 703° C., 704° C., 705° C., 706° C., 707° C., 708° C., 709° C., 710° C., 711° C., 712° C., 713° C., 714° C., 715° C., 716° C., 717° C., 718° C., 719° C., 720° C., 721° C., 722° C., 723° C., 724° C., 725° C., 726° C., 727° C., 728° C., 729° C., 730° C., 731° C., 732° C., 733° C., 734° C., 735° C., 736° C., 737° C., 738° C., 739° C., 740° C., 741° C., 742° C., 743° C., 744° C., 745° C., 746° C., 747° C., 748° C., 749° C., 750° C., 751° C., 752° C., 753° C., 754° C., 755° C., 756° C., 757° C., 758° C., 759° C., 760° C., 761° C., 762° C., 763° C., 764° C., 765° C., 766° C., 767° C., 768° C., 769° C., 770° C., 771° C., 772° C., 773° C., 774° C., 775° C., 776° C., 777° C., 778° C., 779° C., 780° C., 781° C., 782° C., 783° C., 784° C., 785° C., 786° C., 787° C., 788° C., 789° C., 790° C., 791° C., 792° C., 793° C., 794° C., 795° C., 796° C., 797° C., 798° C., 799° C., 800° C., 801° C., 802° C., 803° C., 804° C., 805° C., 806° C., 807° C., 808° C., 809° C., 810° C., 811° C., 812° C., 813° C., 814° C., 815° C., 816° C., 817° C., 818° C., 819° C., 820° C., 821° C., 822° C., 823° C., 824° C., 825° C., 826° C., 827° C., 828° C., 829° C., 830° C., 831° C., 832° C., 833° C., 834° C., 835° C., 836° C., 837° C., 838° C., 839° C., 840° C., 841° C., 842° C., 843° C., 844° C., 845° C., 846° C., 847° C., 848° C., 849° C., 850° C., 851° C., 852° C., 853° C., 854° C., 855° C., 856° C., 857° C., 858° C., 859° C., 860° C., 861° C., 862° C., 863° C., 864° C., 865° C., 866° C., 867° C., 868° C., 869° C., 870° C., 871° C., 872° C., 873° C., 874° C., 875° C., 876° C., 877° C., 878° C., 879° C., 880° C., 881° C., 882° C., 883° C., 884° C., 885° C., 886° C., 887° C., 888° C., 889° C., 890° C., 891° C., 892° C., 893° C., 894° C., 895° C., 896° C., 897° C., 898° C., 899° C., 900° C., 901° C., 902° C., 903° C., 904° C., 905° C., 906° C., 907° C., 908° C., 909° C., 910° C., 911° C., 912° C., 913° C., 914° C., 915° C., 916° C., 917° C., 918° C., 919° C., 920° C., 921° C., 922° C., 923° C., 924° C., 925° C., 926° C., 927° C., 928° C., 929° C., 930° C., 931° C., 932° C., 933° C., 934° C., 935° C., 936° C., 937° C., 938° C., 939° C., 940° C., 941° C., 942° C., 943° C., 944° C., 945° C., 946° C., 947° C., 948° C., 949° C., 950° C., 951° C., 952° C., 953° C., 954° C., 955° C., 956° C., 957° C., 958° C., 959° C., 960° C., 961° C., 962° C., 963° C., 964° C., 965° C., 966° C., 967° C., 968° C., 969° C., 970° C., 971° C., 972° C., 973° C., 974° C., 975° C., 976° C., 977° C., 978° C., 979° C., 980° C., 981° C., 982° C., 983° C., 984° C., 985° C., 986° C., 987° C., 988° C., 989° C., 990° C., 991° C., 992° C., 993° C., 994° C., 995° C., 996° C., 997° C., 998° C., 999° C., 1000° C., 1001° C., 1002° C., 1003° C., 1004° C., 1005° C., 1006° C., 1007° C., 1008° C., 1009° C., 1010° C., 1011° C., 1012° C., 1013° C., 1014° C., 1015° C., 1016° C., 1017° C., 1018° C., 1019° C., 1020° C., 1021° C., 1022° C., 1023° C., 1024° C., 1025° C., 1026° C., 1027° C., 1028° C., 1029° C., 1030° C., 1031° C., 1032° C., 1033° C., 1034° C., 1035° C., 1036° C., 1037° C., 1038° C., 1039° C., 1040° C., 1041° C., 1042° C., 1043° C., 1044° C., 1045° C., 1046° C., 1047° C., 1048° C., 1049° C., 1050° C., 1051° C., 1052° C., 1053° C., 1054° C., 1055° C., 1056° C., 1057° C., 1058° C., 1059° C., 1060° C., 1061° C., 1062° C., 1063° C., 1064° C., 1065° C., 1066° C., 1067° C., 1068° C., 1069° C., 1070° C., 1071° C., 1072° C., 1073° C., 1074° C., 1075° C., 1076° C., 1077° C., 1078° C., 1079° C., 1080° C., 1081° C., 1082° C., 1083° C., 1084° C., 1085° C., 1086° C., 1087° C., 1088° C., 1089° C., 1090° C., 1091° C., 1092° C., 1093° C., 1094° C., 1095° C., 1096° C., 1097° C., 1098° C., 1099° C., or 1100° C.

It is also within the scope of the present disclosure for the softening point of a glaze coating in accordance with the present teachings to fall within one of many different ranges. In a first set of ranges, the softening point of a glaze coating in accordance with the present teachings is in one of the following ranges: about 650° C. to 1099° C., 650° C. to 1095° C., 650° C. to 1090° C., 650° C. to 1085° C., 650° C. to 1080° C., 650° C. to 1075° C., 650° C. to 1070° C., 650° C. to 1065° C., 650° C. to 1060° C., 650° C. to 1055° C., 650° C. to 1050° C., 650° C. to 1045° C., 650° C. to 1040° C., 650° C. to 1035° C., 650° C. to 1030° C., 650° C. to 1025° C., 650° C. to 1020° C., 650° C. to 1015° C., 650° C. to 1010° C., 650° C. to 1005° C., 650° C. to 1000° C., 650° C. to 995° C., 650° C. to 990° C., 650° C. to 985° C., 650° C. to 980° C., 650° C. to 975° C., 650° C. to 970° C., 650° C. to 965° C., 650° C. to 960° C., 650° C. to 955° C., and 650° C. to 950° C. In a second set of ranges, the softening point of a glaze coating in accordance with the present teachings is in one of the following ranges: about 651° C. to 1100° C., 655° C. to 1100° C., 660° C. to 1100° C., 665° C. to 1100° C., 670° C. to 1100° C., 675° C. to 1100° C., 680° C. to 1100° C., 685° C. to 1100° C., 690° C. to 1100° C., 695° C. to 1100° C., 700° C. to 1100° C., 705° C. to 1100° C., 710° C. to 1100° C., 715° C. to 1100° C., 720° C. to 1100° C., 725° C. to 1100° C., 730° C. to 1100° C., 735° C. to 1100° C., 740° C. to 1100° C., 745° C. to 1100° C., 750° C. to 1100° C., 755° C. to 1100° C., 760° C. to 1100° C., 765° C. to 1100° C., 770° C. to 1100° C., 775° C. to 1100° C., 780° C. to 1100° C., 785° C. to 1100° C., 790° C. to 1100° C., 795° C. to 1100° C., and 800° C. to 1100° C. In a third set of ranges, the softening point of a glaze coating in accordance with the present teachings is in one of the following ranges: about 651° C. to 1099° C., 652° C. to 1090° C., 653° C. to 1080° C., 654° C. to 1070° C., 655° C. to 1060° C., 656° C. to 1050° C., 657° C. to 1040° C., 658° C. to 1030° C., 659° C. to 1020° C., 660° C. to 1010° C., and 660° C. to 1000° C.

In some embodiments, a glaze coating may optionally further include an inorganic filler. The inorganic filler may be selected to have a decomposition temperature greater than or equal to about 1200° C. or, in some embodiments, greater than or equal to about 1400° C. The filler may also be chosen to have an average particle size (as determined by the longest linear dimension) of less than or equal to about 13 micrometers. Within this range, the average particle size may range from about 5 nanometers to about 10 micrometers. Representative fillers for use in accordance with the present teachings include but are not limited to silica, fumed silica, hydrophilic fumed silica, wollastonite, organoclay, natural clay, alumina, and a combination thereof.

In some embodiments, a glaze coating may be formed by applying a dispersion of the glaze coating components. Useful carriers for the dispersion include but are not limited to water, alcohol, mineral spirits, acetone, and/or the like, and a combination thereof. The dispersion may be applied to the insulative sleeve of a spark plug subassembly. In some embodiments, a spark plug subassembly includes an insulative sleeve, a center electrode, a resistor, and a terminal stud end. The dispersion may be applied by any appropriate method including but not limited to painting, dip coating, spray coating, and/or the like, and a combination thereof. Any coating applied to the center electrode may be removed by an appropriate method.

The applied dispersion may be allowed to air dry, optionally under air flow, at room temperature for at least about 15 minutes or, in some embodiments, for a period of time ranging from about 1 to about 4 hours. After air drying, the subassembly may then be treated at an elevated temperature, such as from about 650 to about 1100° C., for a period of time from about 20 minutes to about 5 hours or, in some embodiments, from about 0.5 to about 2 hours. The length of time at the elevated temperature is chosen to be sufficient to form a glaze coating.

The electrical resistivity of the insulative sleeve containing a glaze coating in accordance with the present teachings may be greater than or equal to about $1\times10^6$ ohms/mm or, in some embodiments, greater than or equal to about $1\times10^7$ ohms/mm or, in other embodiments, greater than or equal to about $2\times10^7$ ohms/mm prior to use in an engine. After use in an engine using gasoline containing MMT and/or ferrocene, the insulative sleeve including a glaze coating may, in some embodiments, have an electrical resistivity greater than or equal to about $1\times10^6$ ohms/mm.

The following examples and representative procedures illustrate features in accordance with the present teachings, and are provided solely by way of illustration. They are not intended to limit the scope of the appended claims or their equivalents.

EXAMPLES

Insulative sleeves available from Autolite were coated with a 22 weight percent dispersion in acetone of one of the six glaze coatings J1-J6 summarized in Table 2 below. Weight percent is based on the total weight of the dispersion. The glaze coating was applied as a band starting approximately 1 mm from the top edge of the insulative sleeve and continuing to the gasket seal location on the insulator. The insulative sleeves were air dried for 1 hour and then heated to 850° C. and held at that temperature for 1 hour. The insulative sleeve was then combined with the remaining elements to form a spark plug. The spark plugs were tested in an accelerated road test. The spark plugs were put into service and then tested for electrical resistivity using Fostoria Shunt Resistance Analysis. Control spark plugs having no glaze coating were also tested. The shunt resistances were measured between center electrode and metal shell of the spark plug.

Figure 2A:
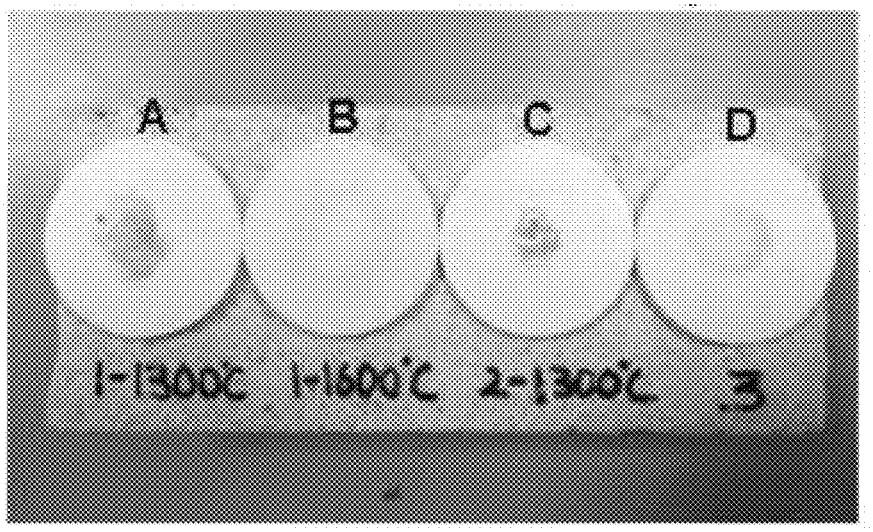
FIG. 2A shows four glazed substrates prior to MMT deposit.
Figure 2B:
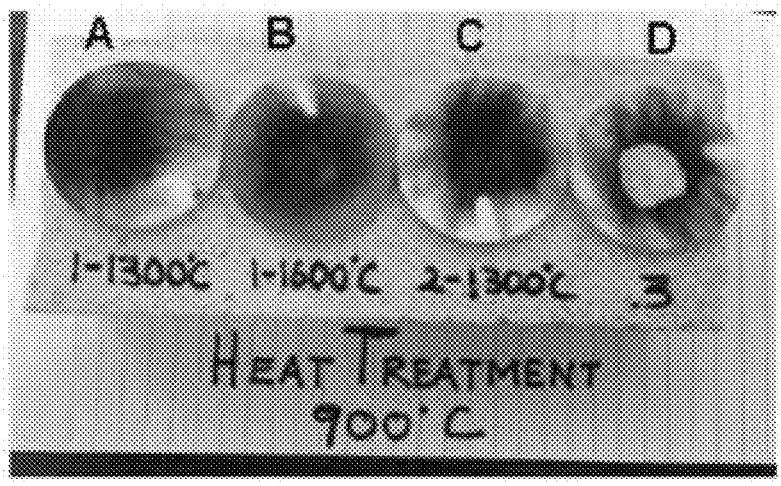
FIG. 2B shows the glazed substrates of FIG. 2A containing MMT deposits following heat treatment at 900° C.

FIG. 2A show four glazed substrates with different softening temperatures, and FIG. 2B shows their corresponding reactivities at 900° C. The glass coating applied to substrates A through D is initially present as a powder, which is then converted into a smooth glass coating via a firing process. Substrate A is fired at 1300° C. and Substrate B is fired at 1600° C. Substrates A and B in FIG. 2A are each coated with a composition described in U.S. Pat. No. 6,166,481. The entire contents of U.S. Pat. No. 6,166,481 are hereby incorporated by reference, except that in the event of any inconsistent disclosure or definition from the present specification, the disclosure or definition herein shall be deemed to prevail. Substrate C is coated with a high-Tg coating and fired at 1300° C. Substrate D is coated with a glaze composition in accordance with the present teachings, which has a Tg between about 650 and about 850° C. After the firing process, MMT deposits are applied to each of the substrates, which are then subjected to a heat treatment process at 900° C. As shown in FIG. 2B, after heat treatment at 900° C., substrate D is the only substrate for which MMT deposits are cleaned.

Figure 3:
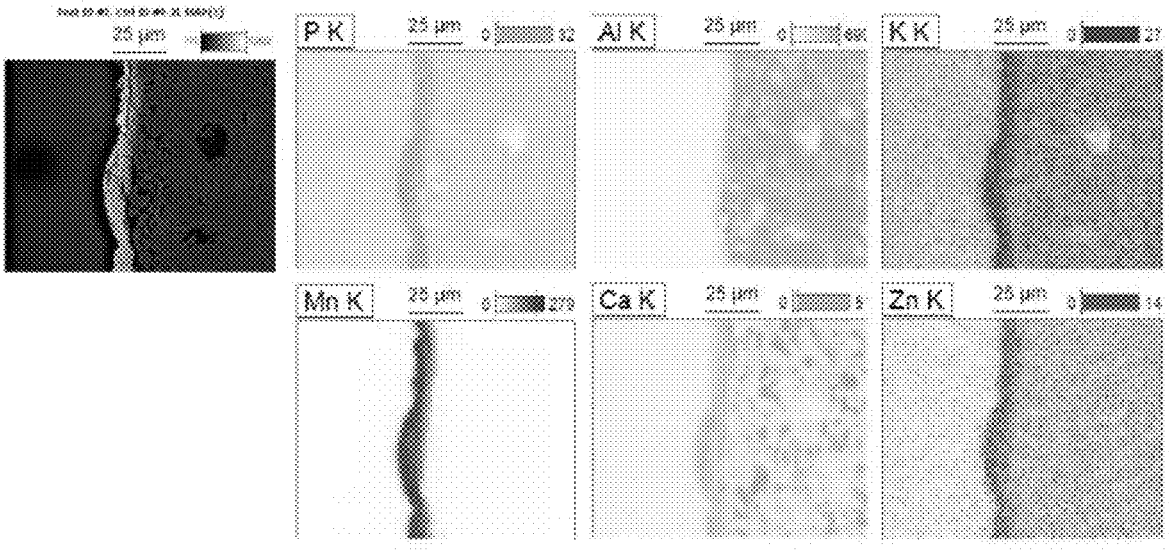
FIG. 3 shows an EDX elemental analysis of MMT deposits on non-coated parts of an insulator after running with MMT-containing fuel.

When a combustion engine runs a fuel doped with MMT and/or ferrocene, deposition of the combustion byproducts may form a dense conductive layer on the surface of the spark plug insulator, as shown in FIG. 3. FIG. 3 shows an EDX elemental analysis for a non-coated (control) spark plug after running with MMT-containing fuel. The EDX elemental analysis confirmed that the deposits on the insulator are mainly manganese oxides. Moreover, the data indicate that the deposit also contains P, K, Ca, and Zn, which are additives in engine oils and lubricants. These trace elements promote densification of the Mn deposits and further reduce the resistivity of the insulator. The conductive deposits may cause "side-firing" of the ignition and lead to incomplete fuel combustion. As a result, the engine will perform at a lower efficiency and have higher hydrocarbon emissions.

Figure 4:
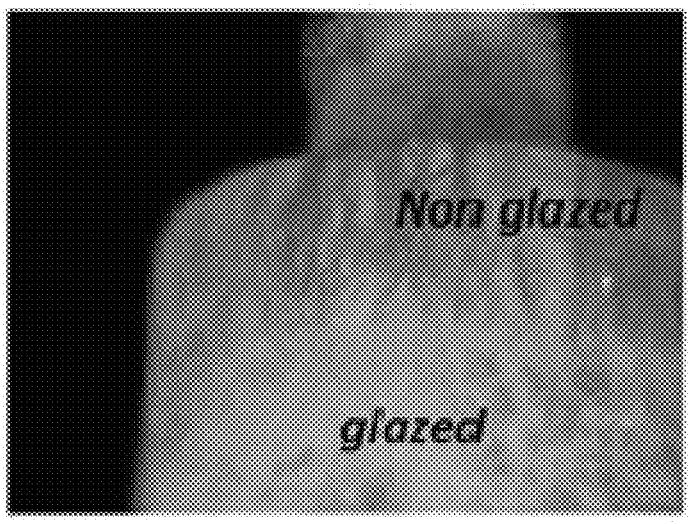
FIG. 4 shows a spark plug with an insulator tip partially coated with glaze material.

It has been found that when a glaze coating in accordance with the present teachings is used on the tip of a spark plug insulator, the above-described side firing may be effectively avoided. FIG. 4 shows a spark plug with an insulator tip partially coated with a glaze material in accordance with the present teachings. In this example, the glaze coating is about 1.5 mm away from the edge. In other embodiments, a distance of about 0.5 mm may be used.

As is evident from FIG. 4, the arcing paths are stopped right at the interface between the coated and non-coated ceramic surface. Moreover, the arcing marks on the partially coated spark plug insulator clearly indicate that a glaze in accordance with the present teachings may prevent formation of conductive paths and may stop arcs from jumping over the glazed surface of the insulator.

Figure 5:
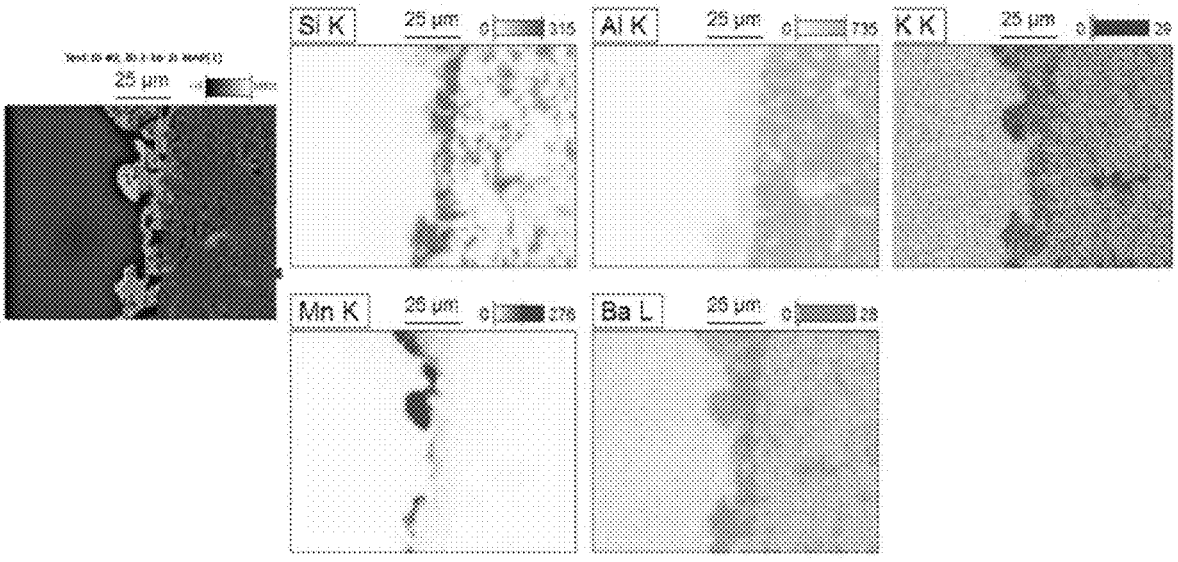
FIG. 5 shows an EDX elemental analysis of an insulator coating after an engine test.
Figure 6:
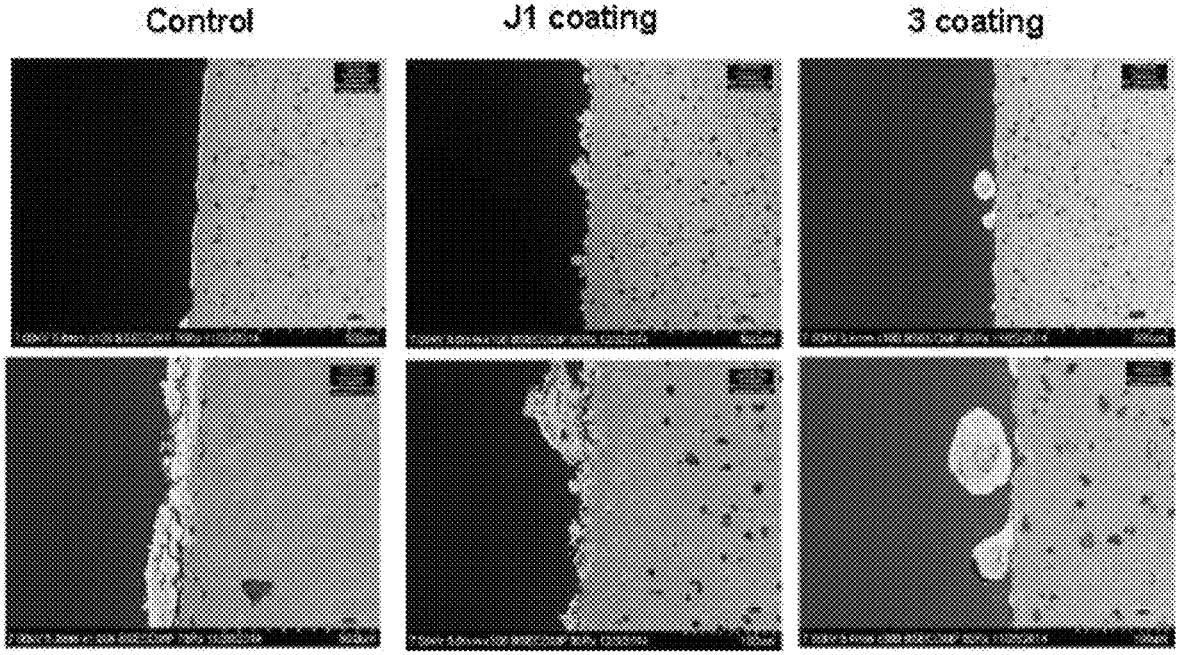
FIG. 6 shows the morphology of an insulator surface with and without an anti-MMT coating.

In accordance with the present teachings, a glaze coating for anti-MMT and/or anti-ferrocene fouling may work in two ways. First, at elevated temperatures, the glaze coating will react with MMT and/or ferrocene deposits, and the resultant coating (e.g., solid solution) is non-conductive even at elevated temperature. Secondly, the incorporation of Mn and/or Fe in the glaze structure will in turn change the material properties of the glass solid solution. This change in properties may cause portions of the coating layer to fall off when the Mn and/or Fe concentration is very high, thus preventing further attack on the matrix material. FIGS. 5 and 6 show, respectively, the EDX elemental analysis and morphology of a coating in accordance with the present teachings after an engine test. FIG. 5 shows the absorption of Mn in glass during the engine application. The Si/Ba distributions indicate the location of the coatings, and the overlap of Mn with Ba suggests that Mn is dissolved in the glaze coating. FIG. 6 shows the morphology of an insulator surface with and without an anti-MMT coating. Continuous MMT deposits were seen on the non-coated (control) part, whereas both of the coated parts show discontinuous deposits due to the coating layer being broken off after absorption of excess amount of MMT deposit.

As described above, a glaze coating in accordance with the present teachings may include a boric acid, a borosilicate glass, a barium borate glass, a phosphorous glass, a silicate glass, or a combination thereof. The glasses may further include a material selected from the group consisting of alkali group metals (e.g., alkali group metal oxides), alkali earth group metals (e.g., alkali earth group metal oxides), aluminum (e.g., alumina), silicon (e.g., silica), halogen (e.g., chloride), and a combination thereof. United States Patent Application Publication No. 2016/0352078 A1, assigned to the assignee of the present invention, describes coatings for an insulator tip of a spark plug, and the teachings therein may be used in accordance with and to supplement the present teachings. The entire contents of U.S. Patent Application Publication No. 2016/0352078 A1 are hereby incorporated by reference, except that in the event of any inconsistent disclosure or definition from the present specification, the disclosure or definition herein shall be deemed to prevail.

Glazes containing boric acid, borosilicate glasses, barium borate glass, and phosphorous glass have been tested and shown to be effective in reducing the electrical conductivity of an MMT deposit. However, some of the glazes tested demonstrated severe devitrification properties at elevated temperature, and hence may not suitable for engine applications. Barium borate glass demonstrated excellent high temperature properties and, in some embodiments, a glaze coating in accordance with the present teachings includes barium borate glass.

Table 1 identifies two formulations of barium borate glass in accordance with the present teachings that were tested at different conditions. In order to be used in different engine applications running at different temperatures (and/or different spark plug with different heat ranges), a high temperature glaze may be mixed with the barium borate glass at different percentages. Table 1 shows a formulation of a high temperature glass that, in some embodiments, may be mixed with one or both of the barium borate glasses. Mod 1 is a barium borate glass comprising Al, Si, Ca, Ba, Na and Cl (halogen) as modifiers. Mod 3 is a barium borate glass comprising Al, Si, Ca, Ba, Na and Cl (halogen) as modifiers. Mod 1 and Mod 3 are barium borate glass with varying modifier compositions. The High Temperature glass (High Temp Glass Table 1) is a silicate glass with Al, Ca and Mg as modifiers. Table 1 shows formulations of high borate glasses and high temperature silicate glass. The resulting coating may therefore be tailored for different temperatures.

TABLE 1

Representative Compositions of Glasses for Use in Anti-MMT Coatings

| Formula | Ba Glass Mod 1 | Ba Glass Mod 3 | High Temp Glass |
|---|---|---|---|
| $Al_2O_3$ | 3.5 | 1.3 | 24.2 |
| $SiO_2$ | 7.2 | 5.0 | 54.0 |
| CaO | 3.2 | 1.4 | 16.0 |
| SrO | 67.5 | 57.4 | — |
| BaO | 15.2 | 32.5 | — |
| $Na_2O$ | 3.4 | 2.3 | — |
| MgO | — | — | 5.8 |
| Cl | 0.1 | 0.1 | — |
| Total | 100 | 100 | 100 |

In some embodiments, one or more mixtures of the glasses summarized in Table 1 may be used to form a glaze coating at the tip of an insulator to prevent MMT and/or ferrocene failure. The ratio of the mixture may be adjusted so that the softening point of the resultant glaze coating may be tailored to a specific engine application. Table 2 summarizes representative coating compositions and their effective temperatures with MMT deposits. The highest resistance read by the meter is 11 Gohms. Therefore, as shown by the data in Table 2, the J1 composition exhibited the best performance characteristics of the samples tested.

TABLE 2

Representative Anti-MMT Glazes and their Effective Temperatures

| | Composition | J1 | J2 | J3 | J4 | J5 | J6 |
|---|---|---|---|---|---|---|---|
| Glaze Formulation | Mod 1 | — | 65% | 45% | — | — | — |
| | Mod 3 | 65% | 35% | 55% | % | 50% | — |
| | High Temp | 35% | | | % | 50% | 100% |
| | Heat Treatment T | Resistance (Gohms) @ 300° C. | | | | | |
| Glazed Alumina with MMT Deposit | As-Coated | 1.15 | 0.2 | 0.13 | 0.27 | 0.35 | 0.37 |
| | 700° C. | 11 | 0.48 | 0.02 | 0.13 | 2.6 | 0.01 |
| | 800° C. | 11 | 3 | 0.02 | 11 | 11 | 0.01 |
| | 900° C. | 11 | 11 | 11 | 11 | 11 | 11 |
| | 1000° C. | 11 | 11 | 11 | 11 | 11 | 11 |

Figure 7A:
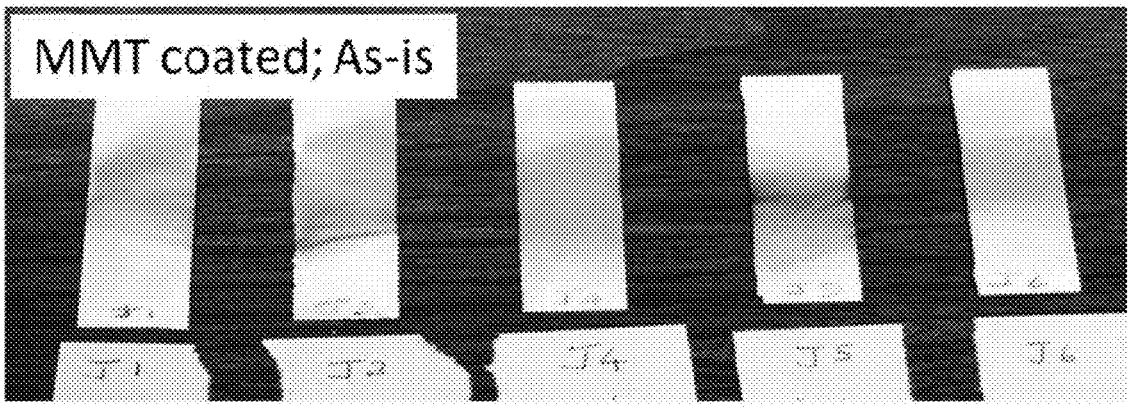
FIG. 7A shows MMT deposits on 5 glazed substrates prior to heat treatment.
Figure 7B:
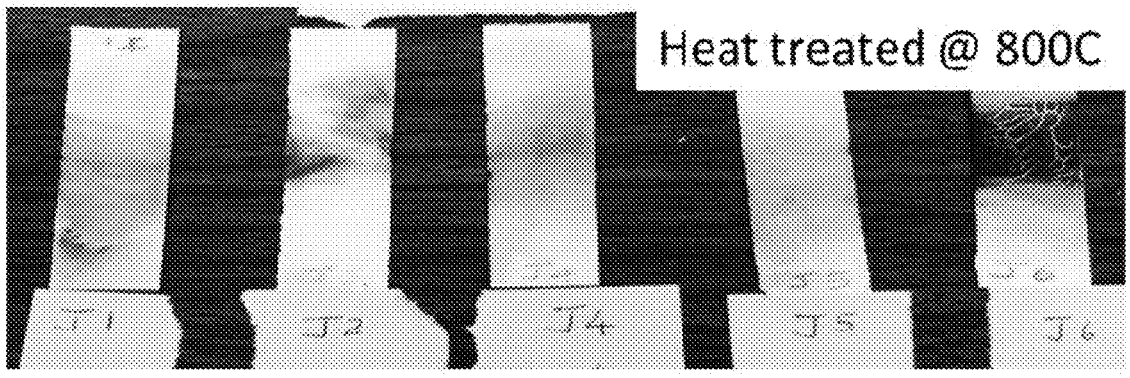
FIG. 7B shows the glazed substrates of FIG. 7A after heat treatment at 800° C.

FIG. 7A shows MMT deposits on 5 glazed alumina substrates prior to heat treatment. The substrates are coated, respectively, with compositions J1, J2, J4, J5, and J6. FIG. 7B shows the glazed substrates of FIG. 7A after heat treatment at 800° C. As shown in FIG. 7B, the substrate coated with J1 exhibited the best performance.

Figure 8A:
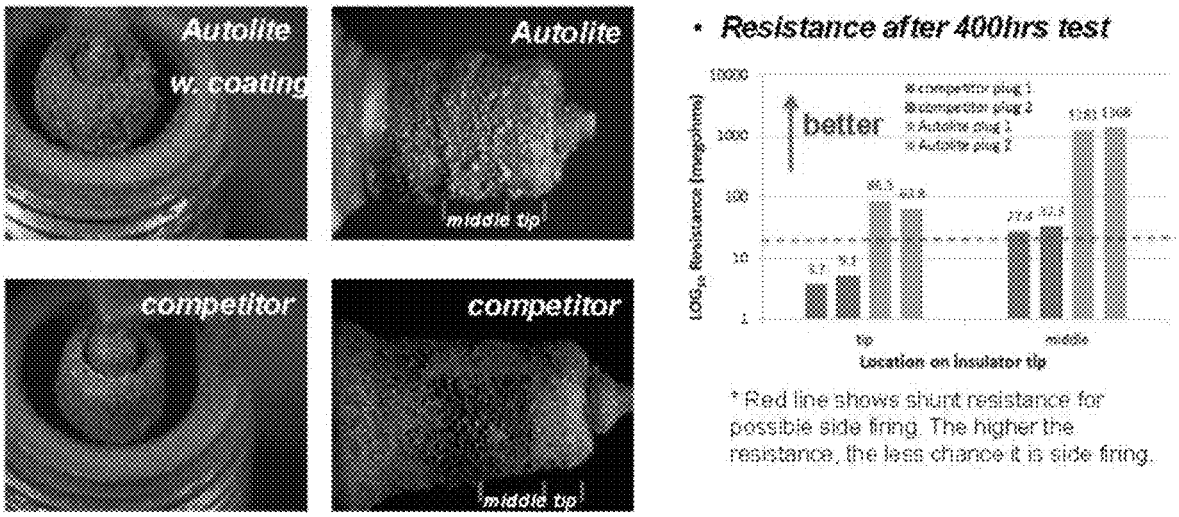
FIG. 8A shows perspective and side views of an insulator tip of a spark plug with a glazed coating in accordance with the present teachings and a conventional spark plug together with a plot of resistance measured after 400 hours of testing.

The left-hand side of FIG. 8A shows perspective and side views of a spark plug with a glazed coating in accordance with the present teachings and a conventional spark plug. The middle and tip portions of the insulator tip are shown in the side views on the left-hand side of FIG. 8A. The right-hand side of FIG. 8A shows a plot of resistance measured after 400 hours of testing for the conventional spark plug and the spark plug in accordance with the present teachings. In the plot shown on the right-hand side of FIG. 8A, the horizontal broken line represents the shunt resistance for possible unwanted side firings. Higher resistance corresponds to reduced chance of unwanted side-firing. As shown by the plot on the right-hand side of FIG. 8A, the spark plugs in accordance with the present teachings ("Autolite plug 1" and "Autolite plug 2") exhibited resistances that were significantly above the shunt resistance threshold.

Figure 8B:
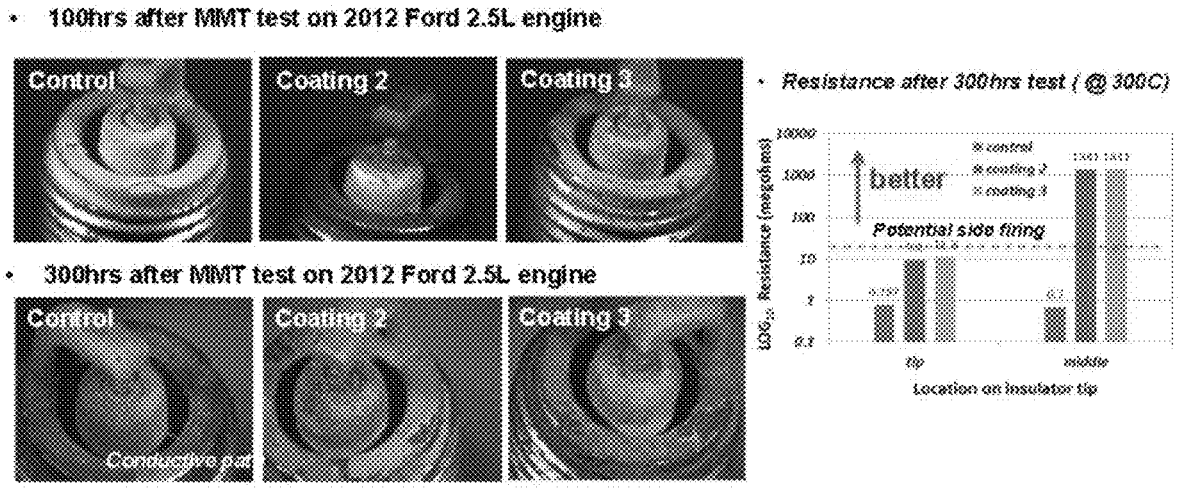
FIG. 8B shows perspective views of an uncoated (control) spark plug and two coated spark plugs in accordance with the present teachings after 100 hours of MMT testing and after 300 hours of MMT testing, together with a plot of resistance after 300 hours of MMT testing.

FIG. 8B shows perspective views of an uncoated (control) spark plug and two coated spark plugs in accordance with the present teachings after 100 hours of MMT testing on a 2012 Ford 2.5-L engine and after 300 hours of MMT testing on a 2012 Ford 2.5-L engine. Significant amounts of side-firing were observed on the non-coated part after 100 hours of testing but not on the coated parts. In addition, as shown in the left-hand side of FIG. 8B, a permanent conductive path was observed on the uncoated control part after 300 hours of testing. The right-hand side of FIG. 8B shows a plot of resistance measured after 300 hours of testing for the control spark plug and the two spark plugs in accordance with the present teachings. In the plot shown on the right-hand side of FIG. 8B, the horizontal broken line once again represents the shunt resistance for possible unwanted side firings. As shown by the plot on the right-hand side of FIG. 8B, the spark plugs in accordance with the present teachings ("coating 2" and "coating 3") exhibited resistances that were significantly above the shunt resistance threshold.

Figure 9:
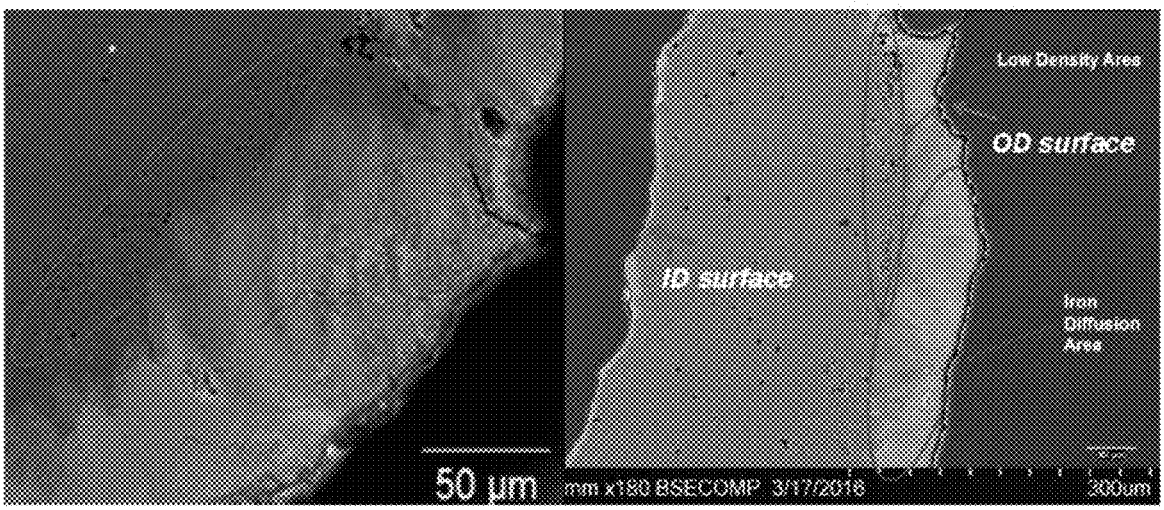
FIG. 9 shows the diffusion of iron into the alumina matrix of an uncoated spark plug.

FIG. 9 shows the diffusion of iron into the alumina matrix observed for an uncoated spark plug tested with a ferrocene-containing fuel. As shown by both of the images in FIG. 9, there is a difference in color between the regions delineated by the two ovals. This difference in color reflects the deposition of iron into the base material. The conductive ferrocene deposit attacks the insulating material (alumina matrix), and forms a high-porosity zone at the interface. As shown in FIG. 9, micro-cracks are generated due to a weakened structure and thermal mismatch.

Figure 10:
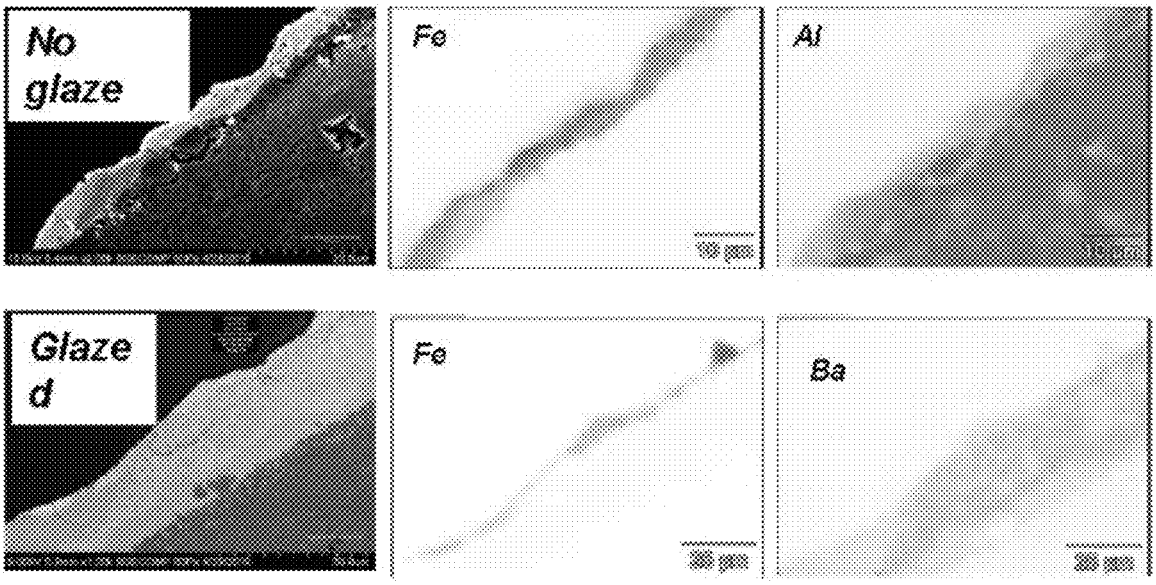
FIG. 10 shows an EDX elemental analysis of ferrocene deposits on an unglazed and a glazed spark plug after running with ferrocene-containing fuel.

FIG. 10 shows an EDX elemental analysis of ferrocene deposits on an unglazed and a glazed spark plug after running with ferrocene-containing fuel. As shown in FIG. 10, iron diffuses into the substrate in the unglazed sample, thereby causing damage to the alumina matrix. Moreover, as further shown by FIG. 10, the glaze coating helps to absorb iron oxide deposit, thereby maintaining the integrity of the alumina structure, and also alters the conductive nature of iron oxides.

Figure 11:
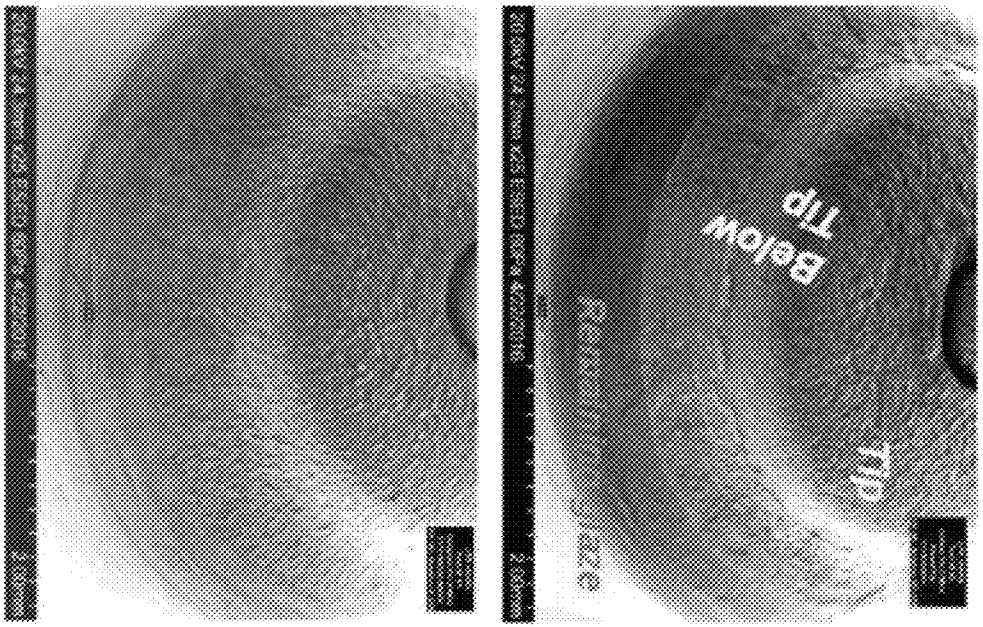
FIG. 11 shows a spark plug coated with a high temperature glaze and an unglazed spark plug.

FIG. 11 shows a spark plug coated with a high temperature glaze and an unglazed spark plug. The resistance was measured at 25° C. and between 350 to 400° C. at the "tip" and "below tip" portions, as shown in FIG. 11. These data are summarized in Table 3 below.

TABLE 3

Resistance Data for High Temperature Glazed and Unglazed Spark Plugs

| | With High Temperature Glaze | No Glaze |
|---|---|---|
| 25° C. tip | 4-8 GΩ | 120-250 MΩ |
| 25° C. below tip | 11 GΩ | 100-200 MΩ |
| 350-400° C. tip | 15-36 MΩ | 12-70 MΩ |
| 350-400° C. below tip | 800-1000 MΩ | 15-80 MΩ |

As shown by the data in Table 3, at room temperature, resistance was higher on the glazed part at both the "tip" and "below tip" locations. At high temperature, resistance was higher on the glazed tip at the "below tip" location. In addition, at high temperature, resistance was similar for glazed and unglazed samples at the "below tip" location due to the loss of glaze on the tip face.

In some embodiments, the resistance of the glaze coating at a position below the firing tip is greater than 300 Mohms at 350° C. to 400° C., in some embodiments greater than 400 Mohms at 350° C. to 400° C., in some embodiments greater than 500 Mohms at 350° C. to 400° C., in some embodiments greater than 600 Mohms at 350° C. to 400° C., in some embodiments greater than 700 Mohms at 350° C. to 400° C., in some embodiments greater than 800 Mohms at 350° C. to 400° C., and in some embodiments greater than 900 Mohms at 350° C. to 400° C.

It is to be understood that use of the indefinite articles "a" and "an" in reference to an element (e.g., "a glass material," "a modifier," etc.) does not exclude the presence, in some embodiments, of a plurality of such elements.

The foregoing detailed description and the accompanying drawings have been provided by way of explanation and illustration, and are not intended to limit the scope of the appended claims. Many variations in the presently preferred embodiments illustrated herein will be apparent to one of ordinary skill in the art, and remain within the scope of the appended claims and their equivalents.

It is to be understood that the elements and features recited in the appended claims may be combined in different ways to produce new claims that likewise fall within the scope of the present invention. Thus, whereas the dependent claims appended below depend from only a single independent or dependent claim, it is to be understood that these dependent claims can, alternatively, be made to depend in the alternative from any preceding claim—whether independent or dependent—and that such new combinations are to be understood as forming a part of the present specification.

The invention claimed is:

1. A spark plug comprising an insulative sleeve having a central axial bore and an exterior surface that is substantially parallel to the central axial bore, wherein a glaze coating is disposed on the exterior surface, wherein the glaze coating is a continuous band located about 0.1 to about 5 millimeters from a top edge of the insulative sleeve, the band having a width of about 1 to about 20 mm, wherein the glaze coating has a softening point between about 650° C. and about 1100° C., wherein the glaze coating is located at a constant distance from about 1 mm to about 3 mm away from the central axial bore, and wherein the glaze coating comprises (a) a barium borate glass material with a respective first modifier selected from the group consisting of an alkali group metal, an alkali earth group metal, aluminum, silicon, a halogen, and a combination thereof, and (b) a high temperature silicate glass material with a respective second modifier selected from the group consisting of an alkali earth group metal, aluminum, and a combination thereof;

a center electrode extending through the central axial bore of the insulative sleeve and having a firing tip that extends beyond the top edge of the insulative sleeve;

a metal shell, wherein the insulative sleeve is positioned within and secured to the metal shell; and a ground electrode supported by the metal shell and positioned in a spaced relationship relative to the center electrode so as to generate a spark gap.

2. The spark plug of claim 1 wherein the first modifier is selected from the group consisting of an alkali group metal oxide, an alkali earth group metal oxide, alumina, silica, a chloride, and a combination thereof.

3. The spark plug of claim 1 wherein the first modifier is selected from the group consisting of alumina, silica, CaO, SrO, BaO, $Na_2O$, MgO, Cl, and a combination thereof.

4. The spark plug of claim 1 wherein the glaze coating further comprises an inorganic filler.

5. The spark plug of claim 4 wherein the inorganic filler is selected from the group consisting of fumed silica, hydrophilic fumed silica, wollastonite, and a combination thereof.

6. The spark plug of claim 1, wherein the glaze coating has a softening point of between about 650 and about 1050° C.

7. The spark plug of claim 1, wherein the glaze coating has a softening point of between about 650 and about 1000° C.

8. The spark plug of claim 1, wherein the glaze coating has a softening point of between about 650 and about 950° C.

9. The spark plug of claim 1, wherein the glaze coating has a thickness of about 1 to about 500 micrometers.

10. The spark plug of claim 1, wherein the glaze coating has a thickness of about 100 to about 400 micrometers.

11. The spark plug of claim 1, wherein the glaze coating has a thickness of about 300 to about 400 micrometers.

12. The spark plug of claim 1, wherein the insulative sleeve has a resistivity of greater than or equal to about $1\times10^6$ ohms/mm prior to use in an engine.

13. A spark plug comprising an insulative sleeve having a central axial bore and an exterior surface that is substantially parallel to the central axial bore, wherein a glaze coating is disposed on the exterior surface, wherein the glaze coating is a continuous band located about 0.1 to about 5 millimeters from a top edge of the insulative sleeve, the band having a width of about 1 to about 20 mm, wherein the glaze coating has a softening point between about 650° C. and about 1000° C., wherein the glaze coating has a thickness of about 100 to about 400 micrometers, wherein the glaze coating is located at a constant distance from about 1 mm to about 3 mm away from the central axial bore, and wherein the glaze coating comprises (a) a barium borate glass material with a first modifier selected from the group consisting of alumina, silica, CaO, SrO, BaO, $Na_2O$, MgO, Cl, and a combination thereof, and (b) a high temperature silicate glass material with a second modifier selected from the group consisting of an alkali earth group metal, aluminum, and a combination thereof;

a center electrode extending through the central axial bore of the insulative sleeve and having a firing tip that extends beyond the top edge of the insulative sleeve;

a metal shell, wherein the insulative sleeve is positioned within and secured to the metal shell; and a ground electrode supported by the metal shell and positioned in a spaced relationship relative to the center electrode so as to generate a spark gap.

14. The spark plug of claim 13, wherein the glaze coating has a glass transition temperature about 700° C. and about 1000° C.

* * * * *